US012611021B2

(12) United States Patent
Jiang

(10) Patent No.: US 12,611,021 B2
(45) Date of Patent: Apr. 28, 2026

(54) MULTIFUNCTIONAL HAIRDRESSING TOOL CAPABLE OF ACHIEVING QUICK HAIR DRYING AND STYLING

(71) Applicant: Dongguan Meisheng Intelligent Technology Co., Ltd, Dongguan (CN)

(72) Inventor: Junmin Jiang, Dongguan (CN)

(73) Assignee: Dongguan Meisheng Intelligent Technology Co., Ltd., Dongguan (CN)

( * ) Notice: Subject to any disclaimer, the term of this patent is extended or adjusted under 35 U.S.C. 154(b) by 502 days.

(21) Appl. No.: 18/350,017

(22) Filed: Jul. 11, 2023

(65) Prior Publication Data

US 2023/0346099 A1 Nov. 2, 2023

(30) Foreign Application Priority Data

May 31, 2022 (CN) ..... 202221349016.X

(51) Int. Cl.
*A45D 20/50* (2006.01)
*A45D 1/18* (2006.01)
*A45D 20/08* (2006.01)

(52) U.S. Cl.
CPC ..... *A45D 20/50* (2013.01); *A45D 1/18* (2013.01); *A45D 20/08* (2013.01)

(58) Field of Classification Search
CPC ..... A45D 20/50
See application file for complete search history.

(56) References Cited

U.S. PATENT DOCUMENTS

| | | | | |
|---|---|---|---|---|
| 8,220,100 | B2 * | 7/2012 | Diamond | A46B 5/0033 132/138 |
| 8,607,470 | B2 * | 12/2013 | Richmond | A45D 2/002 34/100 |
| 11,344,095 | B2 * | 5/2022 | Richmond | A45D 20/50 |
| 2005/0016557 | A1 * | 1/2005 | Fasan | A46B 15/0002 132/132 |
| 2010/0242983 | A1 | 9/2010 | Richmond et al. | |
| 2011/0232672 | A1 | 9/2011 | Ammann | |
| 2016/0242523 | A1 | 8/2016 | Chen | |
| 2017/0095050 | A1 * | 4/2017 | Dineen | A45D 20/50 |
| 2018/0192756 | A1 * | 7/2018 | Bennett | A45D 6/04 |
| 2025/0089871 | A1 * | 3/2025 | Harrison | A45D 2/001 |

FOREIGN PATENT DOCUMENTS

| | | | | |
|---|---|---|---|---|
| CN | 207532056 U | * | 6/2018 | A45D 20/50 |
| CN | 114831400 A | * | 8/2022 | A45D 20/124 |
| FR | 3049830 A1 | * | 10/2017 | A45D 20/10 |
| GB | 2617052 A | * | 10/2023 | A45D 1/06 |

* cited by examiner

*Primary Examiner* — Tatiana L Nobrega
(74) *Attorney, Agent, or Firm* — Hemisphere Law, PLLC

(57) ABSTRACT

The present disclosure relates to the technical field of hairdressing tools, and in particular, to a multifunctional hairdressing tool capable of achieving quick hair drying and styling. The multifunctional hairdressing tool capable of achieving quick hair drying and styling includes a handle main body, wherein the handle main body is provided with an electric control module; a fluid channel is formed in a front end and a rear end of the handle main body in a penetrating manner; a blower assembly is arranged in the fluid channel; a heating frame corresponding to a front portion of the blower assembly is further arranged inside the fluid channel; a fixed iron is mounted at a front end of the handle main body; the handle main body is hinged with a swing arm.

10 Claims, 5 Drawing Sheets

MULTIFUNCTIONAL HAIRDRESSING TOOL CAPABLE OF ACHIEVING QUICK HAIR DRYING AND STYLING

TECHNICAL FIELD

The present disclosure relates to the technical field of hairdressing tools, in particular to, a multifunctional hairdressing tool capable of achieving quick hair drying and styling.

BACKGROUND

With the improvement of the living standard, hairdressing tools have become a frequently used auxiliary hairdressing tool in daily lives, in which, multiple functions are integrated. In terms of the structural design, a handle structure is used as a handle main body. According to the handle structure, an air supply unit is arranged inside the handle structure, and a swinging hair ironing structure is arranged at a front portion of the handle structure for ironing hairs. The hair ironing structure is designed in combination with the air supply unit, so that the air supply unit can provide hot air or cold air to pass through the hair ironing structure to dry the hairs clipped onto the hair ironing structure. A heating element is arranged on the hair ironing structure. After the hairs are clipped, the hairdressing tool is manually pulled out towards a direction parallel to the hairs, which can achieve an effect of styling straight hairs and curly hairs.

However, the existing hair ironing structure is mainly provided with two swing arm structures. Each of the two swing arm structures is provided with two heating sheets. The two swing arm structures perform a clamping operation, so that the heating sheets on the two swing arm structures press against each other, and the hairs are clamped between the two heating sheets. Then, the hairs are pulled to slide between the two heating sheets for heat setting, achieving a straightening effect. Due to the design of this structure, the hairs and the heating sheets are in a pressing sliding fit. Therefore, the heating sheets not only need to have a heat conduction effect, but also need to be in good sliding fit with the hairs. If the hairs are dry, a friction effect between the hairs and the heating sheets would be enhanced, so that the hairs are clamped tightly, which affects the operation of straightening the hairs. Moreover, the hairs are put between the two heating sheets, so that the hairs cannot be uniformly spread. Therefore, only a small part of the hairs can be straightened each time, which is low in efficiency and does not have a hair combing function. During hair straightening, a comb is also needed. It is necessary to propose an improved technical solution to address the above issues.

SUMMARY

In order to overcome the above shortcomings, the present disclosure aims to provide a technical solution capable of addressing the above issues.

A multifunctional hairdressing tool capable of achieving quick hair drying and styling includes a handle main body, wherein the handle main body is provided with an electric control module; a fluid channel is formed in a front end and a rear end of the handle main body in a penetrating manner; a blower assembly is arranged in the fluid channel; a heating frame corresponding to a front portion of the blower assembly is further arranged inside the fluid channel; a fixed iron is mounted at a front end of the handle main body; the handle main body is hinged with a swing arm; a movable iron used for being abutted with the fixed iron is arranged at a front end of the swing arm; the fixed iron is abutted with the movable iron to form a hairdressing channel abutted with the fluid channel; comb teeth corresponding to the hairdressing channel are arranged on both the fixed iron and the movable iron; the comb teeth on the fixed iron and the comb teeth on the movable iron are staggered; a heating piece used for conducting heat of the comb teeth is further arranged in the fixed iron; and the blower assembly, the heating frame, and the heating piece are all electrically connected to the electric control module.

Preferably, the handle main body includes an inner pipe wall and an outer pipe wall surrounding the inner pipe wall; an air outlet is formed in a front end of the outer pipe wall; a mesh enclosure is arranged at a rear end of the outer pipe wall; the blower assembly is mounted at a rear end of the inner pipe wall; a front end of the inner pipe wall is abutted with the air outlet; the heating frame is mounted inside the inner pipe wall; the electric control module is arranged on an inner side of the outer pipe wall; the electric control module is provided with a control button; and the control button is exposed out of the outer pipe wall.

Preferably, a cross section of the swing arm is an arc-shaped structure abutting against the outer pipe wall; two rotating shaft seats are arranged outside the outer pipe wall; a rear end of the swing arm is rotatably connected with the rotating shaft seats through a through hole; a spring structure for supporting the swing arm is connected between the swing arm and the handle main body, so that the movable iron is far away from the fixed iron in a normal state; a structure matching the air outlet is arranged at a front end of the swing arm; and the movable iron is fixed at the front end of the swing arm.

Preferably, a semicircular supporting portion is formed at a periphery of an opening of the air outlet; the semicircular supporting portion is abutted with the front end of the swing arm to form a closed-loop structure wrapping the opening of the air outlet; and the hairdressing channel and the fluid channel are abutted by cooperation between the closed-loop structure and the opening of the air outlet.

Preferably, an accommodating slot is formed outside the semicircular supporting portion; a clamping hole is formed in the accommodating slot; a clamping block is arranged at one end of the fixed iron; and one end of the fixed iron is connected to the accommodating slot, and is clamped and fixed through the clamping block and the clamping hole.

Preferably, a plurality of comb teeth are arranged on each of the fixed iron and the movable iron; the comb teeth on the fixed iron is fixed on the heating piece; and the comb teeth on the movable iron are integrally formed on the movable iron.

Preferably, cross sections of both the fixed iron and the movable iron are of semicircular structures; there are two rows of comb teeth on the fixed iron, and there are three rows of comb teeth on the movable iron; and the three rows of comb teeth on the movable iron are separately formed at edge positions on two sides and a middle position of the movable iron.

Preferably, end portions of the two rows of comb teeth on the fixed iron are integrally combined connecting portions; and the comb teeth are in fixed fit with the heating piece through the connecting portions.

Preferably, two supporting strips are arranged on an inner side of the opening of the air outlet; one end of the heating piece is inserted into the opening of the air outlet, and is supported by the two supporting strips; first fixed structures with holes are arranged on the inner side of the opening of the air outlet, the end of the heating piece inserted into the air outlet, and the connecting portion of one end of each comb tooth; and the air outlet, the heating piece, and the comb teeth are all locked by screws through the holes in the first fixed structures.

Preferably, end portion protection blocks are further arranged at end portions of both the fixed iron and the movable iron; the end portions of both the fixed iron and the movable iron are supported by pressing of the end portion protection blocks; one end of the heating piece away from the air outlet and the other ends of the comb teeth are all in plugging fit with the end portion protection blocks; second fixed structures with holes are arranged at the end of the heating piece away from the air outlet, the connecting portions of the other ends of the comb teeth, and the end portion protection blocks; and the end portion protection blocks, the heating piece, and the comb teeth are all locked by screws through the holes in the second fixed structures.

Compared with the prior art, the present disclosure has the beneficial effects:

Since the fixed iron and the movable iron which act relatively are provided, the fixed iron is in fixed fit with the handle main body, thereby determining the positions of the fluid channel and the hairdressing channel. The blower assembly combined with the heating frame is arranged in the fluid channel, which provides cold air or hot air for the hairdressing channel. The hairdressing channel is used for placing to-be-combed hairs. Due to the swing arm, the movable iron is arranged on the swing arm. After the swing arm is closed, the movable iron is abutted with the fixed iron to clamp the hairs between them. At this time, the hairdressing channel is enclosed, and an air flow provided for the hairdressing channel will flow out from front ends of the fixed iron and the movable iron along the hairdressing channel. This process achieves an air drying operation on the hairs clamped in the channel of the swing arm. The heating piece is arranged in the hairdressing channel, which performs heat setting on the hairs in the hairdressing channel. The hairdressing tool is pulled out along the hair direction, thus achieving an effect of styling straight hairs and curly hairs.

Based on this, the comb teeth are arranged on both the fixed iron and the movable iron, and are in staggering fit. Due to this design, the hairs placed on the hairdressing tool can be spread to perform the hair straightening operation more effectively. Furthermore, since the comb teeth are staggered, gaps are reserved between the comb teeth, which generates compression-free sliding friction between the hairs and the comb teeth and makes the hair straightening process smoother. In addition, the comb teeth have a hair combing effect. In the hair straightening process, the comb teeth can play a hair combing role at the same time. Therefore, a comb is not used to comb hairs when the hairdressing tool is used, and the hair straightening efficiency is greatly improved.

Additional aspects and advantages of the present disclosure will be provided in the following descriptions, and will become apparent from the following descriptions or be learned through the practice of the present disclosure.

BRIEF DESCRIPTION OF THE DRAWINGS

In order to describe the embodiments of the present disclosure or the technical solutions in the prior art more clearly, drawings required to be used in the embodiments or the illustration of the existing art will be briefly introduced below. Obviously, the drawings in the illustration below are merely some embodiments of the present disclosure. Those ordinarily skilled in the art also can acquire other drawings according to the provided drawings without doing creative work.

Figure 1:
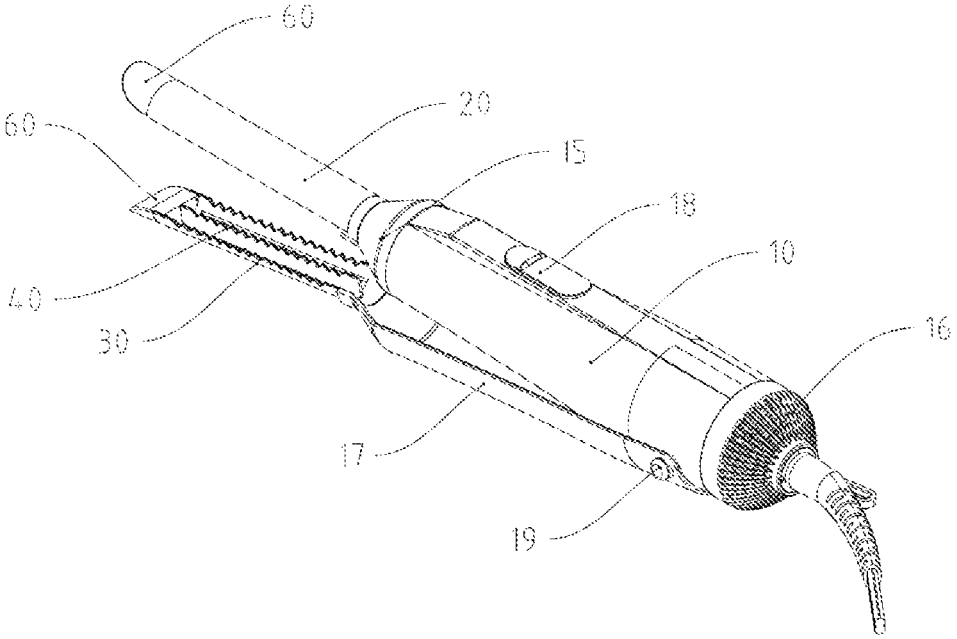
FIG. 1 is a schematic structural diagram of a normal state of the present disclosure.

Reference numerals and names in the drawings are as follows:

handle main body 10, fixed iron 20, movable iron 30, comb teeth 40, heating piece 50, protection block 60, blower assembly 11, heating frame 12, inner pipe wall 13, outer pipe wall 14, air outlet 15, mesh enclosure 16, swing arm 17, electric control module 18, rotating shaft seat 19, clamping block 21, connecting portion 41, second fixed structure 61, semicircular supporting portion 151, accommodating slot 152, clamping hole 153, supporting strip 154, first fixed structure 155, and spring structure 171.

DETAILED DESCRIPTION OF THE EMBODIMENTS

The technical solutions in the embodiments of the present disclosure will be described clearly and completely below. Obviously, the embodiments described herein are only part of the embodiments of the present disclosure, not all the embodiments. Based on the embodiments in the present disclosure, all other embodiments obtained by those of ordinary skill in the art without creative work shall fall within the protection scope of the present disclosure.

Referring to FIG. 1 to FIG. 5, in the embodiments of the present disclosure, a multifunctional hairdressing tool capable of achieving quick hair drying and styling includes a handle main body 10. A fluid channel is formed in a front end and a rear end of the handle main body 10 in a penetrating manner. A blower assembly 11 is arranged in the fluid channel. A heating frame 12 corresponding to a front portion of the blower assembly 11 is further arranged inside the fluid channel. Specifically, the handle main body 10 includes an inner pipe wall 13 and an outer pipe wall 14 surrounding the inner pipe wall 13. An air outlet 15 is formed in a front end of the outer pipe wall 14. A mesh enclosure 16 is arranged at a rear end of the outer pipe wall 14. The blower assembly 11 is mounted at a rear end of the inner pipe wall 13. A front end of the inner pipe wall 13 is abutted with the air outlet 15. The heating frame 12 is mounted inside the inner pipe wall 13. Due to this design, in the handle main body 10, the fluid channel is mainly an interior of the inner pipe wall 13. When the blower assembly 11 works, an air flow generated passes through the heating frame 12 and is blown out from the air outlet 15.

Based on this, a fixed iron 20 is mounted at a front end of the handle main body 10. The handle main body 10 is hinged with a swing arm 17. A movable iron 30 used for being abutted with the fixed iron 20 is arranged at a front end of the swing arm 17. The fixed iron 20 is abutted with the movable iron 30 to form a hairdressing channel abutted with the fluid channel. The hairdressing channel is used for generating a guided air flow to dry hairs in the hairdressing channel.

The fixed iron 20 has a first comb with comb teeth 40 and the moveable iron 30 has a second comb disposed centrally between two rows of integrally formed comb teeth. Comb teeth 40 corresponding to the hairdressing channel are arranged on both the fixed iron 20 and the movable iron 30, and the comb teeth 40 on the fixed iron 20 and the comb teeth 40 on the movable iron 30 are staggered. A heating piece 50 used for conducting heat of the comb teeth 40 is further arranged in the fixed iron 20. The comb teeth 40 are used for combing the hairs, so that the hairs can also be combed by the comb teeth 40 after being clamped between the fixed iron 20 and the movable iron 30, to achieve an effect of fluffing the hairs. Based on this, the heating piece 50 is designed, so that heat setting can be performed on the hairs passing through the hairdressing tool to achieve a hair straightening effect.

Therefore, since the fixed iron 20 and the movable iron 30 which act relatively are provided, the fixed iron 20 is in fixed fit with the handle main body 10, thereby determining the positions of the fluid channel and the hairdressing channel. The blower assembly 11 combined with the heating frame 12 is arranged in the fluid channel, which provides cold air or hot air for the hairdressing channel. The hairdressing channel is used for placing to-be-combed hairs. Due to the swing arm 17, the movable iron 30 is arranged on the swing arm 17. After the swing arm 17 is closed, the movable iron 30 is abutted with the fixed iron 20 to clamp the hairs between them. At this time, the hairdressing channel is enclosed, and the air flow provided for the hairdressing channel will flow out from front ends of the fixed iron 20 and the movable iron 30 along the hairdressing channel. This process achieves an air drying operation on the hairs clamped in the channel of the swing arm 17. The heating piece 50 is arranged in the hairdressing channel, which performs the heat setting on the hairs in the hairdressing channel. The hairdressing tool is pulled out along the hair direction, thus achieving an effect of styling straight hairs and curly hairs. The comb teeth 40 are arranged on both the fixed iron 20 and the movable iron 30, and are in staggering fit. Due to this design, the hairs placed on the hairdressing tool can be spread to perform the hair straightening operation more effectively. Furthermore, since the comb teeth 40 are staggered, gaps are reserved between the comb teeth 40, which generates compression-free sliding friction between the hairs and the comb teeth 40 and makes the hair straightening process smoother. In addition, the comb teeth 40 have a hair combing effect. In the hair straightening process, the comb teeth can play a hair combing role at the same time. Therefore, a comb is not used to comb hairs when the hairdressing tool is used, and the hair straightening efficiency is greatly improved.

The above operations performed on the blower assembly 11, the heating frame 12, and the heating piece 50, the handle main body 10 is provided with an electric control module 18. The blower assembly 11, the heating frame 12, and the heating piece 50 are all electrically connected to the electric control module 18. The electric control module 18 is arranged on an inner side of the outer pipe wall 14. The electric control module 18 is provided with a control button. The control button is exposed out of the outer pipe wall 14.

Figure 2:
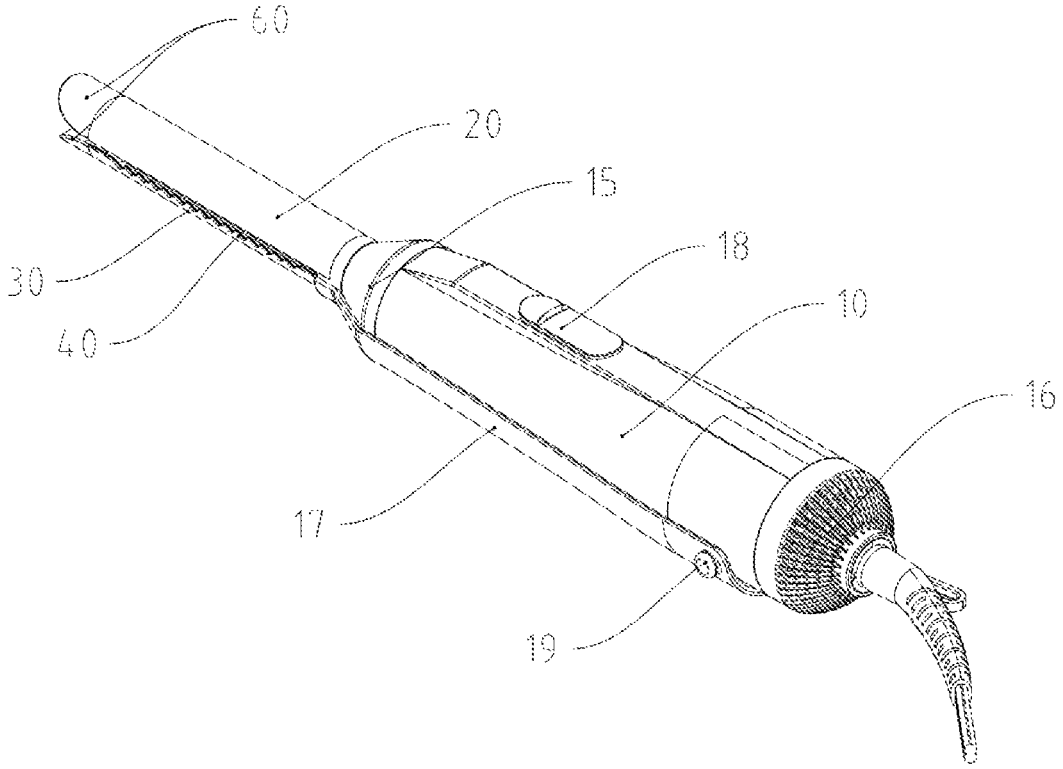
FIG. 2 is a schematic structural diagram after a fixed iron and a movable iron are closed according to the present disclosure.
Figure 3:
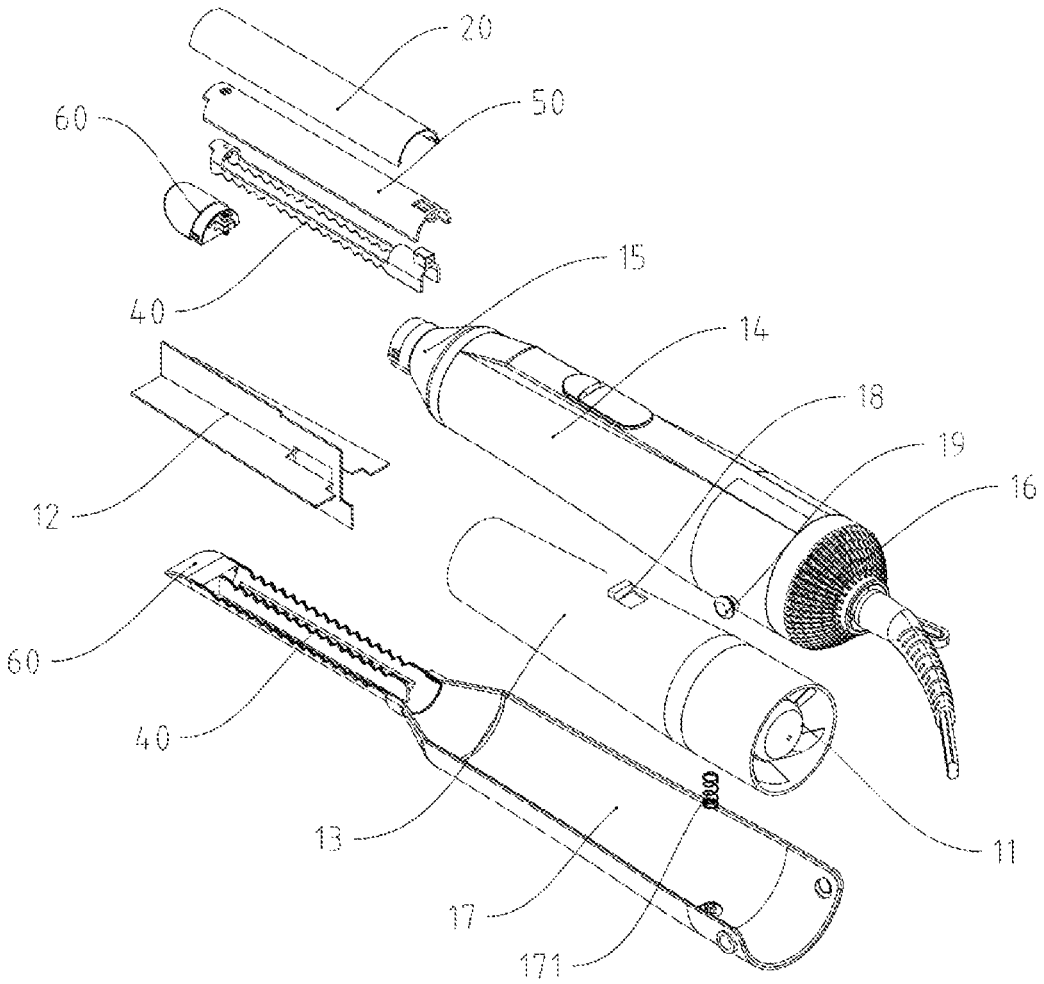
FIG. 3 is an exploded structural diagram of the present disclosure.

Referring to FIG. 1 to FIG. 3, a cross section of the swing arm 17 is an arc-shaped structure abutting against the outer pipe wall 14. Two rotating shaft seats 19 are arranged outside the outer pipe wall 14. A rear end of the swing arm 17 is rotatably connected with the rotating shaft seats 19 through a through hole. A spring structure 171 for supporting the swing arm 17 is connected between the swing arm 17 and the handle main body 10, so that the movable iron 30 is far away from the fixed iron 20 in a normal state. A structure matching the air outlet 15 is arranged at a front end of the swing arm 17. The movable iron 30 is fixed at the front end of the swing arm 17. The structure of the swing arm 17 is reasonably designed, so that the overall structural design of the hairdressing tool is attractive and compact.

Referring to FIG. 2 to FIG. 5, a semicircular supporting portion 151 is formed at a periphery of an opening of the air outlet 15. The semicircular supporting portion 151 is abutted with the front end of the swing arm 17 to form a closed-loop structure wrapping the opening of the air outlet 15. The hairdressing channel and the fluid channel are abutted by cooperation between the closed-loop structure and the opening of the air outlet 15. According to this structure, an accommodating slot 152 is formed outside the semicircular supporting portion 151. A clamping hole 153 is formed in the accommodating slot 152. A clamping block 21 is arranged at one end of the fixed iron 20. One end of the fixed iron 20 is connected to the accommodating slot 152, and is clamped and fixed through the clamping block 21 and the clamping hole 153.

Referring to FIG. 1 to FIG. 3, a plurality of comb teeth 40 are arranged on each of the fixed iron 20 and the movable iron 30. The comb teeth 40 of the first comb on the fixed iron 20 is fixed on the heating piece 50. The comb teeth 40 on the movable iron 30 are integrally formed on the movable iron 30. Specifically, cross sections of both the fixed iron 20 and the movable iron 30 are of semicircular structures. There are two rows of comb teeth 40 on the fixed iron 20, and there are three rows of comb teeth 40 on the movable iron 30. The three rows of comb teeth 40 on the movable iron 30 are separately formed at edge positions on two sides and a middle position of the movable iron 30. A quantity of the comb teeth 40 is designed according to the semicircular structures of the fixed iron 20 and the movable iron 30. The comb teeth 40 on the movable iron 30 are more than the comb teeth 40 on the fixed iron 20, so that more hairs can be pushed towards the heating piece 50 by the comb teeth 40 on the movable iron 30, thereby improving the working efficiency of the heating piece 50. It should be considered that when the comb teeth 40 on the fixed iron 20 and the comb teeth 40 on the movable iron 30 are in staggering fit, the hairs will be slightly bent. The hairs will be curled only if the hairs are slightly bent for certain time, so that the hair straightening effect can also be achieved according to a normal speed during use.

Figure 4:
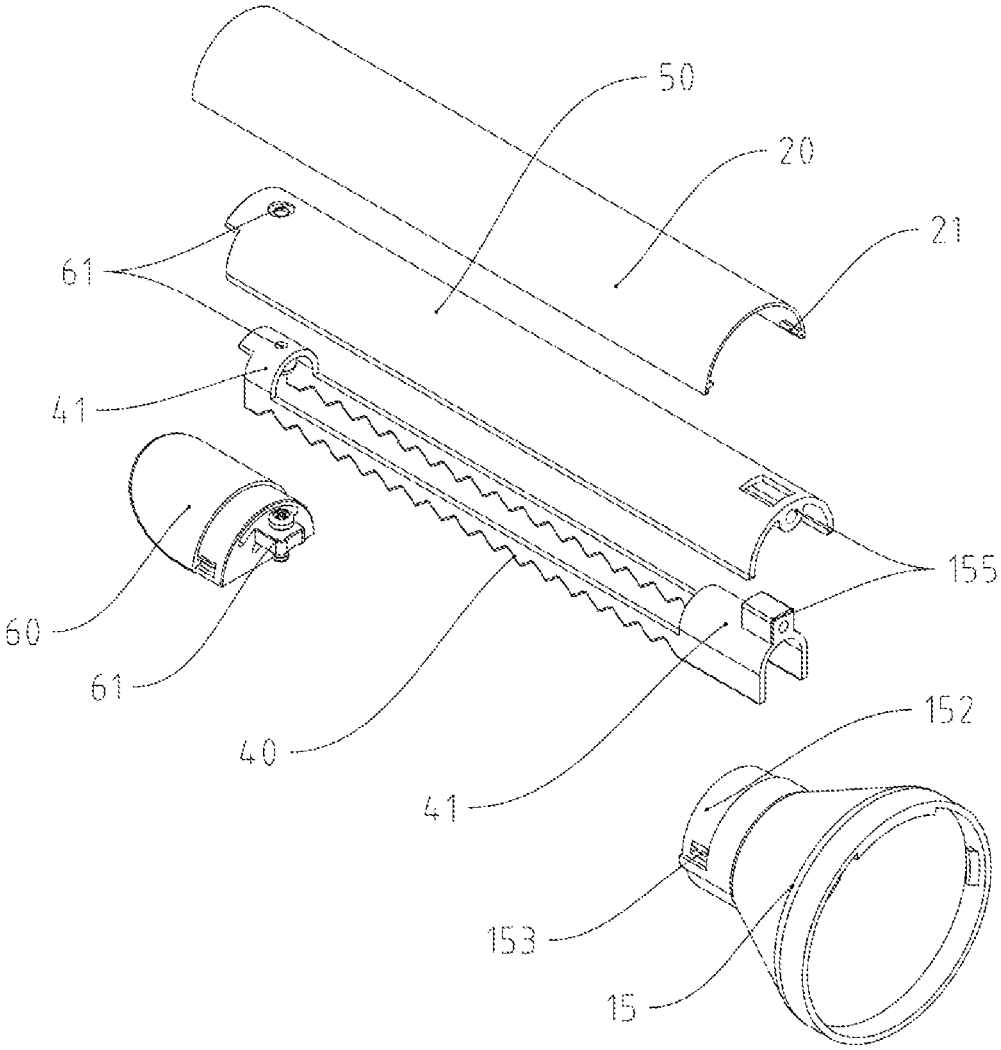
FIG. 4 is an exploded structural diagram of an air outlet and all parts connected in front of the air outlet in the present disclosure.
Figure 5:
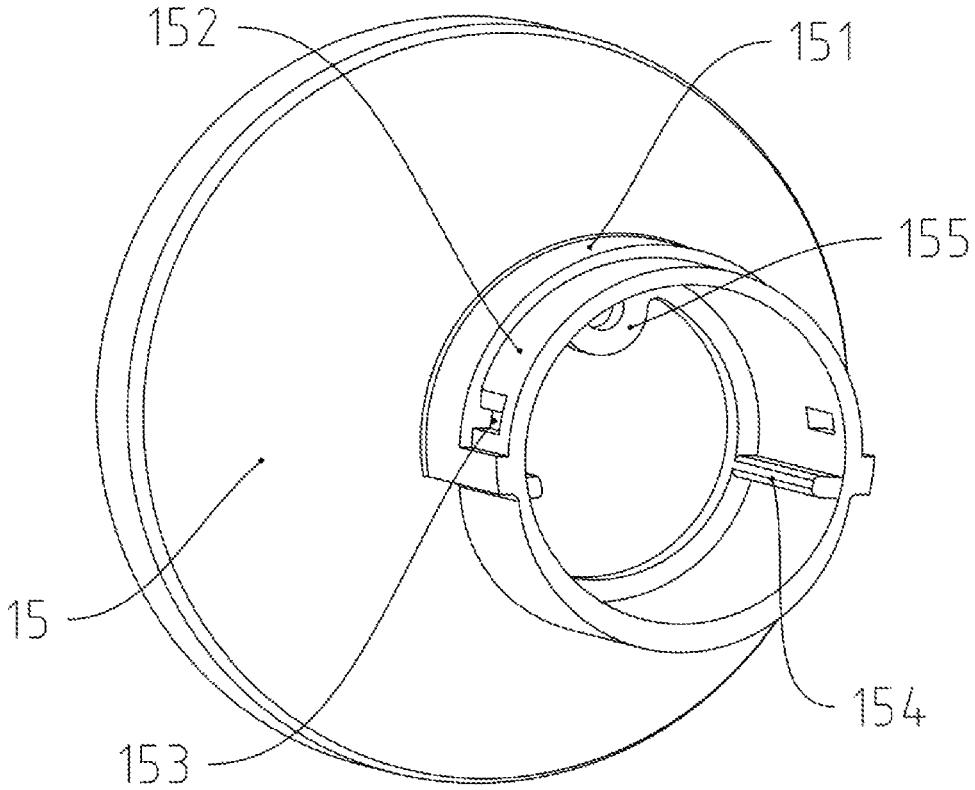
FIG. 5 is a schematic structural diagram of an air outlet in the present disclosure.

Referring to FIG. 4 to FIG. 5, end portions of the two rows of comb teeth 40 on the fixed iron 20 are integrally combined connecting portions 41. The two rows of comb teeth 40 are in fixed fit with the heating piece 50 through the connecting portion 41. Two supporting strips 154 are arranged on an inner side of the opening of the air outlet 15. One end of the heating piece 50 is inserted into the opening of the air outlet 15, and is supported by the two supporting strips 154. First fixed structures 155 with holes are arranged on the inner side of the opening of the air outlet 15, the end of the heating piece 50 inserted into the air outlet 15, and the connecting portion 41 of one end of each comb tooth 40. The air outlet 15, the heating piece 50, and the comb teeth 40 are all locked by screws through the holes in the first fixed structures 155. End portion protection blocks 60 are further arranged at end portions of both the fixed iron 20 and the movable iron 30. The end portions of both the fixed iron 20 and the movable iron 30 are supported by pressing of the end portion protection blocks 60. One end of the heating piece 50 away from the air outlet 15 and the other ends of the comb teeth 40 are all in plugging fit with the end portion protection blocks 60. Second fixed structures 61 with holes are arranged at the end of the heating piece 50 away from the air outlet 15, the connecting portions 41 of the other ends of the comb teeth 40, and the end portion protection blocks 60. The end portion protection blocks 60, the heating piece 50, and the comb teeth 40 are all locked by screws through the holes in the second fixed structures 61. Due to this design, the comb teeth 40, the heating piece 50, and the fixed iron 20 are assembled and fixed. The structural design can make the fixed iron 20 reasonably avoid the heating piece 50. The structural design is firm and reliable.

For those skilled in the art, it is apparent that the present disclosure is not limited to the details of the demonstrative embodiments mentioned above, and that the present disclosure can be realized in other specific forms without departing from the spirit or basic features of the present disclosure. Therefore, from any point of view, the embodiments should be regarded as exemplary and non-limiting. The scope of the present disclosure is defined by the appended claims rather than the above description. Therefore, all changes falling within the meanings and scope of equivalent elements of the claims are intended to be included in the present disclosure.

What is claimed is:

1. A multifunctional hairdressing tool capable of achieving quick hair drying and styling, comprising:

a handle main body, wherein the handle main body is provided with an electric control module;

a fluid channel formed within the handle main body extending in a longitudinal direction from a front end to a rear end of the handle main body in a penetrating manner;

an air outlet disposed at the front end of the handle main body;

a blower assembly arranged in the fluid channel;

a heating frame corresponding to a front portion of the blower assembly is further arranged inside the fluid channel;

a fixed iron mounted to the air outlet, the fixed iron having a semicircular cross-sectional shape along its length;

a heating piece arranged on an inner concave surface of the fixed iron, the heating piece having a semicircular cross section along its length;

a swing arm hingedly coupled to the handle main body;

a movable iron arranged at a front end of the swing arm, the moveable iron having a semicircular cross-sectional shape along its length;

a first comb secured to the heating piece, where the first comb comprises at least one row of comb teeth and the heating piece conducts heat to the first comb;

the fixed iron abuts with the movable iron to form a hairdressing channel for clamping hair when the swing arm is in a closed position, wherein the hair dressing channel is cylindrical and a rear end of the hairdressing channel abuts with the fluid channel;

a second comb arranged within the hairdressing channel adjacent an inner concave surface of the movable iron;

the at least one row of comb teeth on the fixed iron and the comb teeth of the second comb on the movable iron are staggered; and the blower assembly, the heating frame, and the heating piece are all electrically connected to the electric control module;

wherein during use, the blower assembly draws ambient air into the rear end of the handle main body and propels it through the fluid channel where the air is heated by the heating frame, heated air exits the air outlet and flows in the longitudinal direction through the rear end of the hairdressing channel and along the entire length thereof.

2. The multifunctional hairdressing tool capable of achieving quick hair drying and styling according to claim 1, wherein the handle main body comprises an inner pipe wall and an outer pipe wall surrounding the inner pipe wall; the air outlet is formed in a front end of the outer pipe wall; a mesh enclosure is arranged at a rear end of the outer pipe wall; the blower assembly is mounted at a rear end of the inner pipe wall; a front end of the inner pipe wall is abutted with the air outlet; the heating frame is mounted inside the inner pipe wall; the electric control module is arranged on an inner side of the outer pipe wall; the electric control module is provided with a control button; and the control button is exposed through the outer pipe wall.

3. The multifunctional hairdressing tool capable of achieving quick hair drying and styling according to claim 2, wherein the swing arm is an arc-shaped structure abutting against the outer pipe wall; two rotating shaft seats are arranged outside the outer pipe wall; a rear end of the swing arm is rotatably connected with the rotating shaft seats through a through hole; a spring structure for supporting the swing arm is connected between the swing arm and the handle main body, so that the movable iron is spaced apart from the fixed iron in a normal state; a structure matching the air outlet is arranged at a front end of the swing arm; and the movable iron is fixed at the front end of the swing arm.

4. The multifunctional hairdressing tool capable of achieving quick hair drying and styling according to claim 3, wherein a semicircular supporting portion is formed at a periphery of an opening of the air outlet; the semicircular supporting portion is abutted with the front end of the swing arm to form a closed-loop structure wrapping the opening of the air outlet; and the hairdressing channel and the fluid channel are abutted by cooperation between the closed-loop structure and the opening of the air outlet.

5. The multifunctional hairdressing tool capable of achieving quick hair drying and styling according to claim 4, wherein an accommodating slot is formed on an exterior portion of the semicircular supporting portion; a clamping hole is formed in the accommodating slot; a clamping block is arranged at a rear end of the fixed iron; and the clamping block is coupled to the clamping hole.

6. The multifunctional hairdressing tool capable of achieving quick hair drying and styling according to claim 4, wherein the movable iron includes at least one row of integrally formed comb teeth.

7. The multifunctional hairdressing tool capable of achieving quick hair drying and styling according to claim 6, the at least one row of comb teeth of the fixed iron includes two rows of comb teeth, and the at least one row of integrally formed comb teeth of the movable iron includes two rows of integrally formed comb teeth on opposite longitudinal edges of the moveable iron, where the second comb is disposed centrally between the two rows of integrally formed comb teeth.

8. The multifunctional hairdressing tool capable of achieving quick hair drying and styling according to claim 7, wherein the two rows of comb teeth of first comb the fixed iron each have front and rear end portions which are integrally combined connecting portions; and the first comb is in fixed fit with the heating piece through the connecting portions.

9. The multifunctional hairdressing tool capable of achieving quick hair drying and styling according to claim 8, wherein two supporting strips are arranged on an inner side of the opening of the air outlet; one end of the heating piece is inserted into the opening of the air outlet, and is supported by the two supporting strips; first fixed structures with holes are arranged on the inner side of the opening of the air outlet, the end of the heating piece inserted into the air outlet, and the connecting portion of one end of each of the two rows of comb teeth of the fixed iron; and the air outlet, the heating piece, and the two rows of comb teeth of the fixed iron are all locked by screws through the holes in the first fixed structures.

10. The multifunctional hairdressing tool capable of achieving quick hair drying and styling according to claim 9, wherein end portion protection blocks are further arranged at front end portions of both the fixed iron and the movable iron; the front end portions of both the fixed iron and the movable iron are supported by pressing of the end portion protection blocks; a front end of the heating piece away from the air outlet and a front end of the first comb are in plugging fit with the end portion protection block of the fixed iron; second fixed structures with holes are arranged at the front end of the heating piece, the connecting portions of the front end of the first comb, and the end portion protection block of the fixed iron; and the end portion protection block of the fixed iron, the heating piece, and the first comb are all locked by screws through the holes in the second fixed structures.

* * * * *